US008231333B2

(12) United States Patent
Ragg

(10) Patent No.: US 8,231,333 B2
(45) Date of Patent: Jul. 31, 2012

(54) FAN UNIT HAVING A FAN

(75) Inventor: Peter Ragg, Schönwald (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 651 days.

(21) Appl. No.: 12/367,567

(22) Filed: Feb. 9, 2009

(65) Prior Publication Data

US 2009/0202342 A1 Aug. 13, 2009

(30) Foreign Application Priority Data

Feb. 8, 2008 (DE) ..... 10 2008 009 839

(51) Int. Cl.
*F03D 11/00* (2006.01)

(52) U.S. Cl. ..... 415/119; 415/124; 415/200; 415/215.1; 415/220; 416/500

(58) Field of Classification Search ..... 415/119, 415/200, 215.1, 220, 124, 124.2; 416/500
See application file for complete search history.

(56) References Cited

U.S. PATENT DOCUMENTS

| | | | | |
|---|---|---|---|---|
| 5,096,373 | A * | 3/1992 | Struve et al. | 415/60 |
| 6,505,807 | B1 | 1/2003 | Nolting et al. | 248/638 |
| 7,189,053 | B2 | 3/2007 | Winkler et al. | 415/108 |
| 7,677,964 | B1 * | 3/2010 | Bucher et al. | 454/356 |
| 2004/0228722 | A1 * | 11/2004 | Horng et al. | 415/66 |

FOREIGN PATENT DOCUMENTS

| | | | |
|---|---|---|---|
| CH | 406 221 | B | 3/1966 |
| DE | 199 05075 | A1 | 8/2000 |
| DE | 100 02231 | A1 | 8/2001 |
| DE | 100 19572 | A1 | 10/2001 |
| DE | 102004033215 | | 2/2005 |
| DE | 202005011514 | | 10/2005 |
| DE | 102005015853 | | 6/2007 |
| EP | 1 780 419 | A2 | 5/2007 |
| EP | 1816728 | A | 8/2007 |
| GB | 953057 | | 3/1964 |
| WO | WO 2006-048481 | | 5/2006 |

* cited by examiner

*Primary Examiner* — Thao Le
*Assistant Examiner* — Geoffrey Ida
(74) *Attorney, Agent, or Firm* — Milton Oliver, Esq.; Oliver Intellectual Property LLC

(57) ABSTRACT

A fan unit has a fan (10). Associated with the fan is an air-guiding tube (22) through which the fan (10) transports air, during operation. The air-guiding tube (22) is connected to at least one carrier tube (23) for suspension of the fan (10). The fan includes a carrier part (25). A damping member (30) is arranged between the carrier part (25) and the carrier tube (23) to reduce any structure-borne sound which occurs during operation of the fan (10).

17 Claims, 7 Drawing Sheets

FAN UNIT HAVING A FAN

CROSS-REFERENCE TO RELATED APPLICATION(S)

This application claims priority from German application DE 10 2008 009 839.6, filed 8 Feb. 2008, the disclosure of which is hereby incorporated by reference.

FIELD OF THE INVENTION

The present invention relates to a fan unit having a fan.

BACKGROUND

Fans usually exhibit a manufacturing-related imbalance. This, along with commutation of the fan motor, can lead to the occurrence of undesirable structure-borne sound during operation of the fan, so that irritating noise is produced during fan operation. The structure-borne sound must therefore be at least reduced, especially in convenience-related applications.

SUMMARY OF THE INVENTION

It is therefore an object of the invention to provide a novel fan unit having a fan producing relatively little structure-borne noise.

This object is achieved by a fan unit having a fan supported in a carrier part, a carrier tube surrounding and supporting the fan and carrier part, an air-guiding tube surrounding the carrier tube, and a damping, preferably elastomeric, member arranged intermediate the carrier part and the carrier tube. The use of a damping member made of a soft plastic results in a reduction of the structure-borne sound generated during operation of the fan, and thus in improved damping of vibration and noise.

BRIEF FIGURE DESCRIPTION

Further details and advantageous refinements of the invention are evident from the exemplifying embodiments, in no way to be understood as a limitation of the invention, that are described below and depicted in the drawings, in which.

Figure 1:
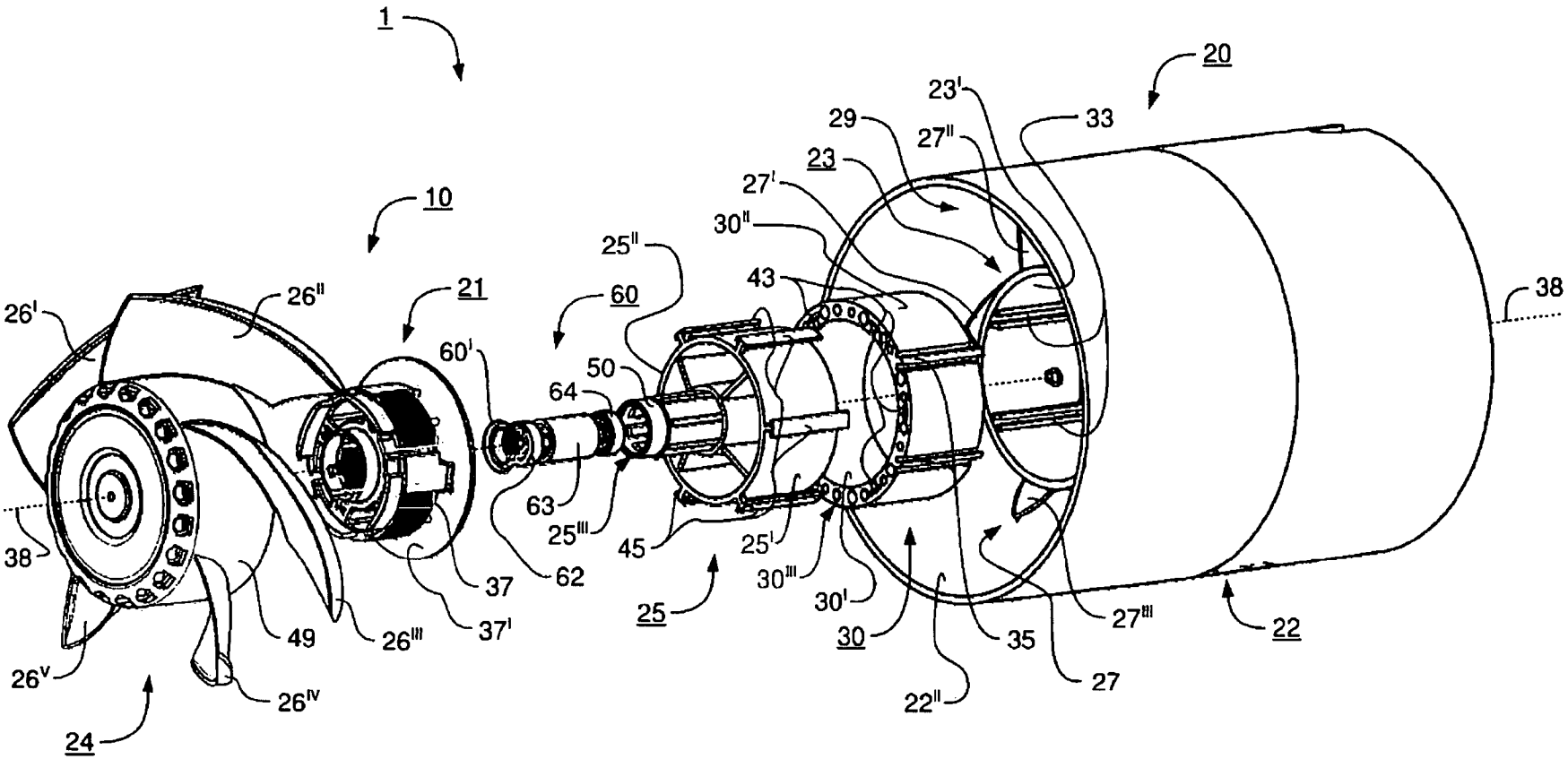
FIG. 1 is an exploded perspective depiction of a fan unit having an apparatus for carrying an axial fan, in accordance with an embodiment.
Figure 2:
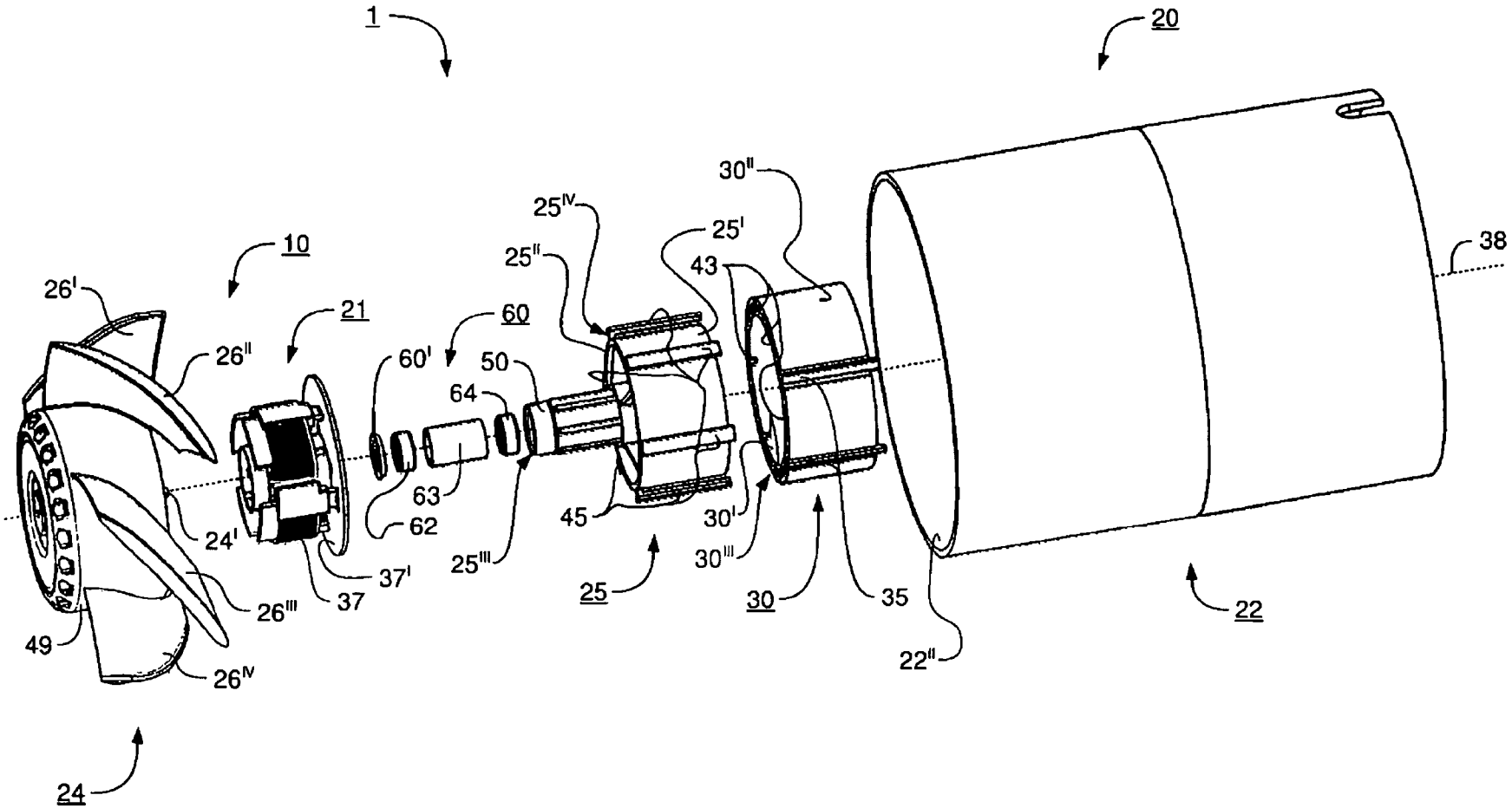
FIG. 2 is an exploded depiction of the fan unit of FIG. 1 from a different viewing angle.
Figure 6:
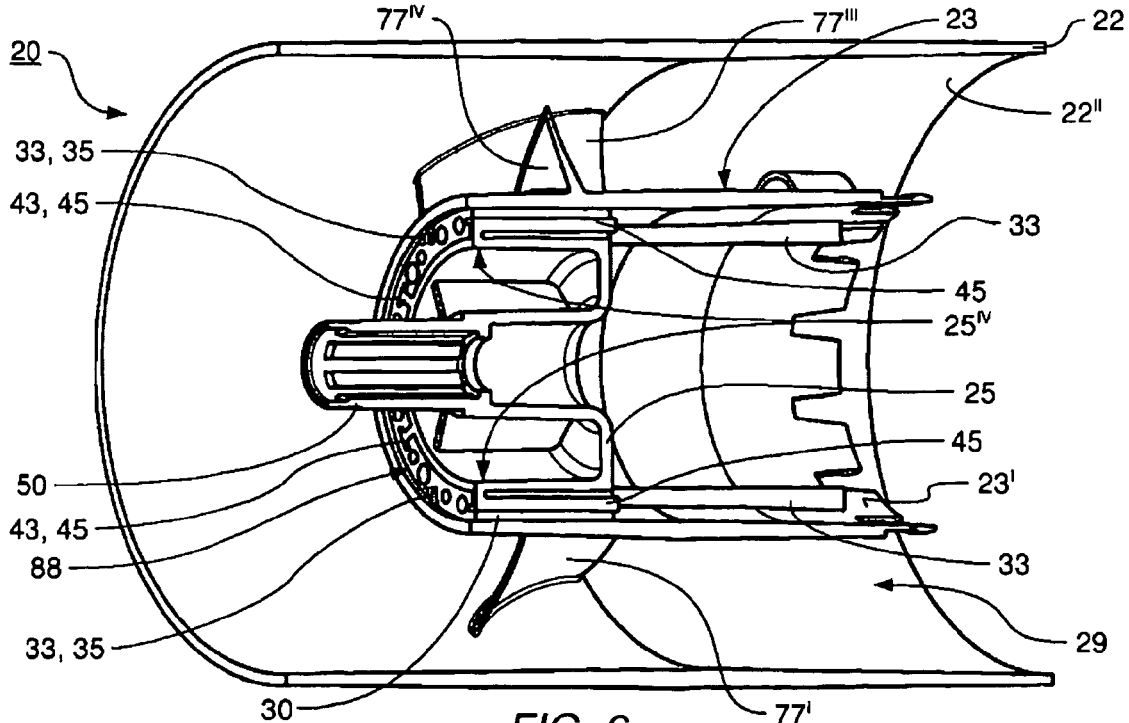
FIG. 6 is a longitudinal section, looking in the direction of line VI-VI of FIG. 3.
Figure 8:
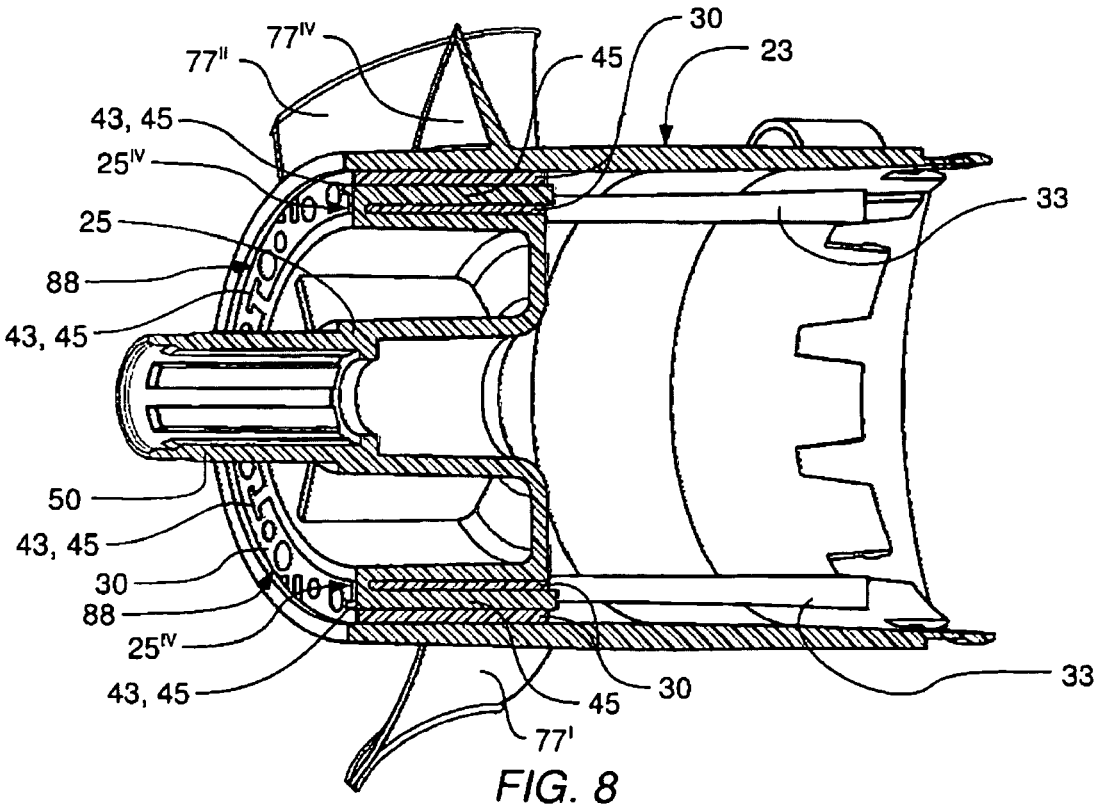
Figure 9:
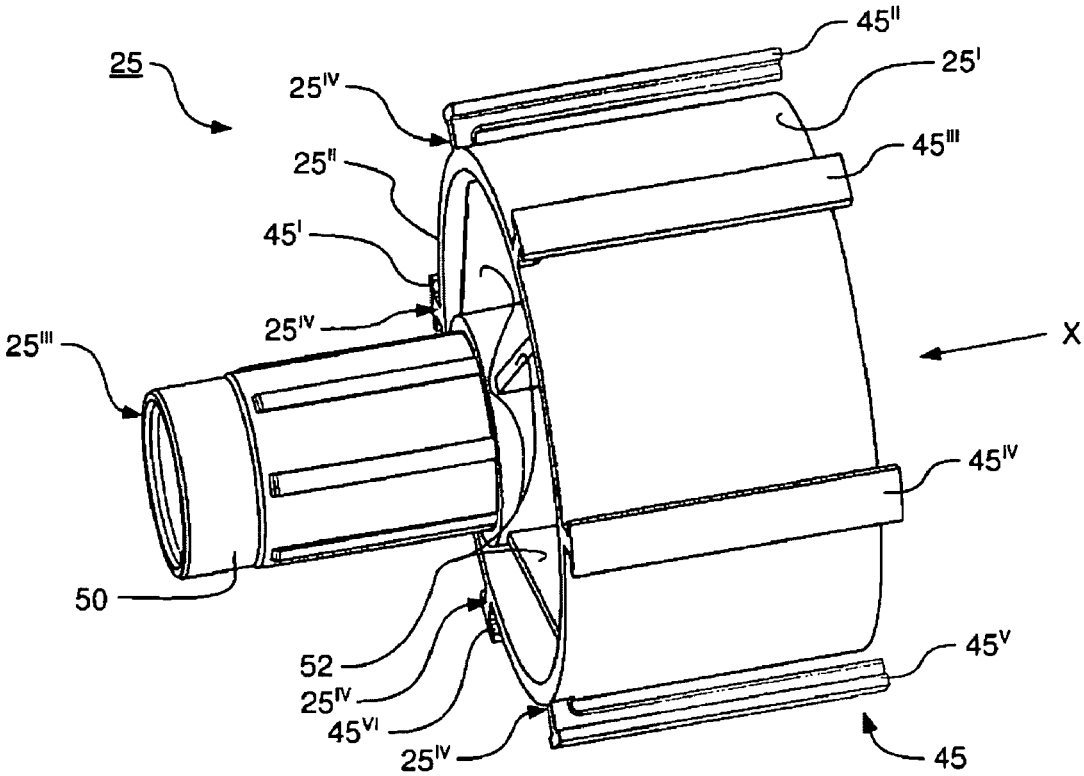
Figure 10:
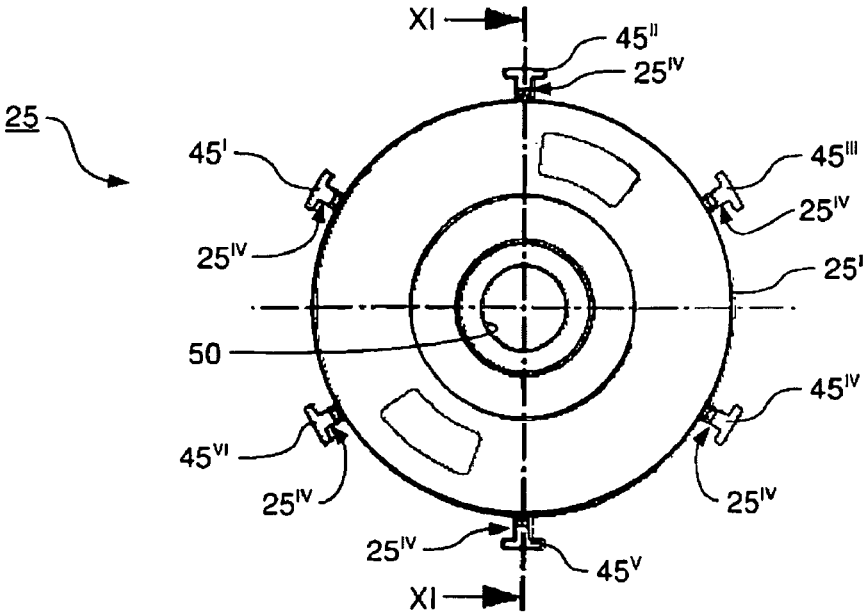
Figure 11:
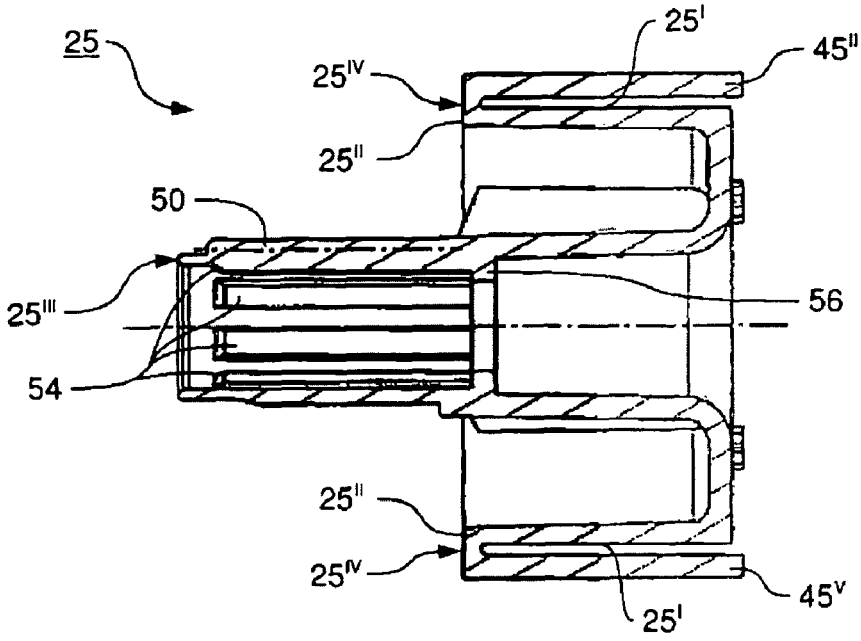
Figure 12:
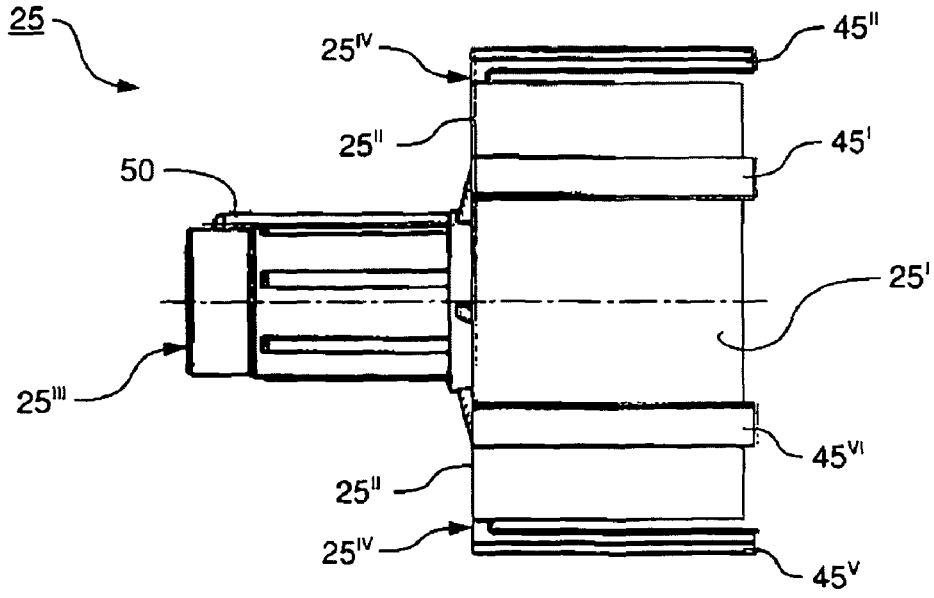

FIG. 8 is an enlarged sectioned view of carrier tube 23, damping ring 30, and carrier part 25 of FIG. 6;

FIG. 9 is a perspective view of carrier part 25 of FIGS. 1 and 2;

FIG. 10 is a plan view of carrier part 25 of FIG. 9, looking in the direction of arrow X of FIG. 9;

FIG. 11 is a sectioned view of carrier part 25 of FIGS. 1 and 2, looking in the direction of arrow XI of FIG. 10; and FIG. 12 is a side view of carrier part 25 of FIGS. 1 and 2.

DETAILED DESCRIPTION

In the description that follows, the terms "left," "right," "front," "back," "upper," and "lower" refer to the respective figure of the drawings, and can vary from one figure to the next as a function of a particular orientation (portrait or landscape) that is selected. Identical or identically functioning parts are labeled with the same reference characters in the various figures, and usually are described only once.

FIG. 1 and FIG. 2 show, in exploded depictions from different viewing angles, an embodiment of a fan unit 1 having a fan 10 and an apparatus 20 to reduce the structure-borne sound generated during the operation of fan 10. Fan 10 is not limited, in this context, to the use of specific fan types, for example axial fans, and is depicted as an axial fan merely by way of example. Other fan types, for example diagonal fans, can likewise be used.

Fan 10 has a rotor cup 24 having a rotor shaft 24' (FIG. 2), and has an electronically commutated external-rotor motor 21 having a stator arrangement 37 that is fastened on a stator carrier 37'. Motor 21 serves to drive a fan wheel 49 associated with fan 10, said wheel being fastened on rotor cup 24.

Apparatus 10 has an air-guiding tube 22 through which air is transported to fan 10 during operation; it also has at least one inner support tube (carrier tube) 23 for the suspension of fan 10, at least one sound-damping member 30 to reduce the occurrence of structure-borne sound, and a carrier part 25 to carry fan 10. Air-guiding tube 22 can be implemented integrally from hard plastic or metal, or in any desired mixed form thereof. Provided on its inner periphery 22" are one or more struts 27, on which carrier tube 23 is fastened. Three struts 27', 27", 27'" are shown by way of example in FIG. 1.

Carrier tube 23 and air-guiding tube 22 are preferably connected so as not to rotate with respect to one another, and form an annular channel 29 for fan 10. The latter's fan wheel 49 has fan blades 26' to 26$^{v}$ whose shape is adapted to the shape of inner side 22" of air-guiding tube 22, and is rotatable about a rotation axis 38 that extends along the longitudinal axis of air-guiding tube 22. Upon rotation about this rotation axis 38, fan wheel 49 generates an air flow in annular channel 29 between air-guiding tube 22 and carrier tube 23.

A plurality of guidance grooves 33 are provided on inner periphery 23' of carrier tube 23. These serve to receive guidance bars 35 that are provided on outer periphery 30" of damping member 30, which is embodied here as a damping ring or damping tube. A plurality of recesses 43 are provided on said member 30. These serve to receive support elements 45 that are provided on outer periphery 25' of carrier part 25. As is evident from FIGS. 9, 11, and 12, support elements 45 are cantilevered, at least partly resilient components that are each fastened only with portions 25$^{IV}$ to an outer edge 25" of carrier part 25.

Carrier part 25 has a bearing tube 50 associated with fan 10, the tube being connected to carrier part 25, for example, by plastic injection-molding. Bearing tube 50 serves to receive a bearing arrangement 60 that has a first rolling bearing 62, a second rolling bearing 64, and a spacing member 63 to space rolling bearings 62, 64 apart from one another. Rolling bearings 62, 64 and spacing member 63 are immobilized with a retaining washer 60' in front region 25'" of bearing tube 50, as described with reference to FIGS. 11 and 12. Bearing arrangement 60 is not limited to one specific bearing type;

instead, a variety of bearing types can be used, e.g. rolling bearings, plain bearings, or magnetic bearings.

The assembly and manufacture of fan unit 1 will be described below in detail. Be it noted, however, that the depiction selected in FIG. 2 serves merely to illustrate the structure of fan unit 1, without thereby indicating an absolutely necessary assembly sequence for putting together its individual components, or a corresponding manufacturing step.

For assembly of fan unit 1, firstly bearing arrangement 60 is introduced into bearing tube 50 and fastened therein, preferably by being pressed in, in order to prevent arrangement 60 from sliding out of tube 50 during the operation of fan 10. Stator arrangement 37 is then slid over bearing tube 50 onto carrier part 25 so that stator carrier 37' abuts against upper edge 25" (FIG. 12) of carrier part 25. Rotor shaft 24' (FIG. 2) of rotor cup 24 is then slid into bearing arrangement 60 in bearing tube 50 and immobilized, proceeding from the right side of carrier part 25 in FIG. 2, in order to prevent shaft 24' from sliding out of bearing arrangement 60 during the operation of fan 10.

Carrier part 25 and damping ring 30 are manufactured using two-component technology, carrier part 25 being implemented preferably from a first plastic having a first hardness, and damping ring 30 being implemented preferably from a second plastic having a second hardness, the second hardness being less hard, or softer, than the first hardness. Production using two-component technology is accomplished in such a way that support elements 45 of carrier part 25 engage into the recesses 43 of damping ring 30. Recesses 43 are implemented to receive the support elements 45 in such a way that float-mounting of carrier part 25 in damping ring 30 is achieved. Support elements 45 and recesses 43 are implemented in such a way that carrier part 25 is connected nonrotatably to damping ring 30.

Damping ring 30 and carrier tube 23 are likewise preferably manufactured using two-component technology, so that guidance bars 35 of damping ring 30 engage into guidance grooves 33 of carrier tube 23. A nonrotating connection of damping ring 30 to carrier tube 23 is thereby achieved.

According to an embodiment of the invention, fan unit 1 is implemented in such a way that air-guiding tube 22 is connected, in the region of damping ring 30, to carrier tube 23 via struts 27. In other words, after the assembly of fan unit 1, damping ring 30 is arranged at the point where air-guiding tube 22 is connected via struts 27 to carrier tube 23. Air-guiding tube 22 and carrier tube 23 are preferably formed from a hard plastic.

When fan 10 is in operation, motor 21 drives fan wheel 49 in such a way that the latter rotates about rotation axis 38 in order to generate an air flow. In this context, the structure-borne sound resulting, for example, from an imbalance of fan 10 is damped by apparatus 20.

The mass of fan unit 1 that excites structure-borne sound is decreased by the positioning of damping ring 30 in fan unit 1. Possible deformations of damping ring 30 during the operation of fan 10 as a result of the fan's own weight or that of damping ring 30 are reduced in this context by the fact that a majority of the support elements 45 of carrier part 25 are float-mounted in recesses 43. These elements prevent damping ring 30, or carrier part 25 equipped with fan 10, from moving down relative to carrier tube 23. In addition, the attachment of support elements 45 at outer edge 25" (FIG. 10) of carrier part 25 by means of portions $\mathbf{25}^{IV}$ can prevent tilting and inhomogeneous deformation of damping ring 30 in its front region 30''', where stator arrangement 37 and rotor cup 24 create the greatest weight of fan unit 1 and thus exert the greatest load during the operation of fan 10.

Because the deformation of damping ring 30 can be efficiently reduced by the actions described above, it is also possible to minimize the size of a gap between fan blades 26' to $\mathbf{26}^{V}$ and inner periphery 22' of air-guiding tube 22, which gap serves to prevent contact between fan blades 26 and inner periphery 22" of air-guiding tube 22 during the operation of fan 10. The air output of fan unit 1 can be improved by minimizing this gap in this fashion.

Figure 3:
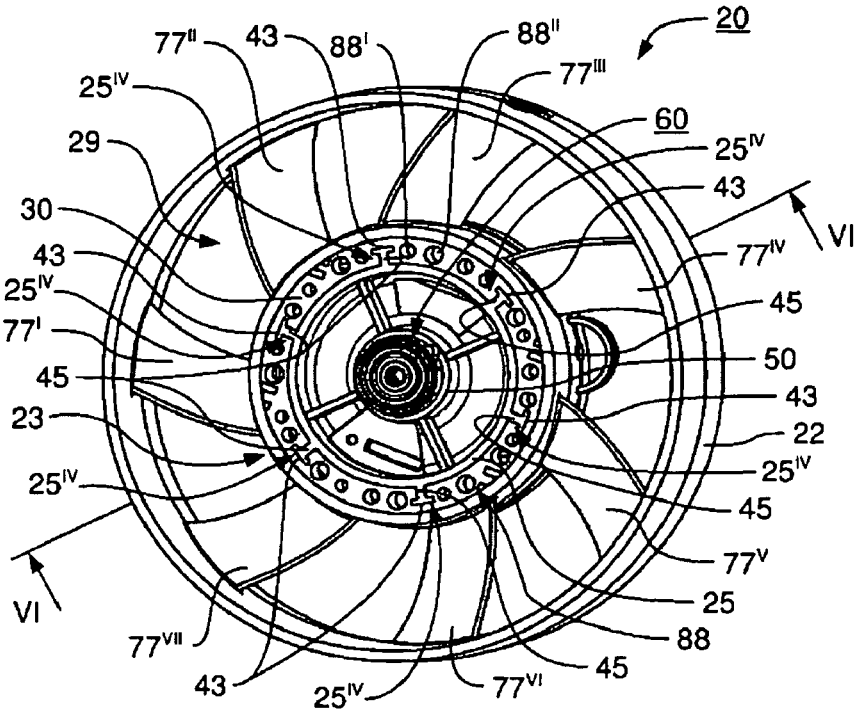
FIG. 3 is a perspective view of the front side of apparatus 20 of FIGS. 1 and 2.

FIG. 3 is a perspective view of the front side of apparatus 20 of FIGS. 1 and 2, illustrating the fastening of carrier tube 23 in air-guiding tube 22. Carrier tube 23 is preferably fastened via a plurality of struts 77' to $\mathbf{77}^{VII}$ (seven struts in this case), which are implemented in such a way that their effects on the flow properties of fan unit 1 are minimized. FIG. 3 further illustrates the positioning of damping ring 30 in that region of fan unit 1 of FIGS. 1 and 2 in which air-guiding tube 22 is connected via struts 77' to $\mathbf{77}^{VII}$ to carrier tube 23, as well as the arrangement of bearing arrangement 60 in bearing tube 50.

As is apparent from FIG. 3, carrier part 25 can tilt radially only to the extent allowed by portions $\mathbf{25}^{IV}$ of support elements 45, which portions interact with damping ring 30. These portions $\mathbf{25}^{IV}$ are illustrated in FIGS. 8 to 11 and are preferably implemented from hard plastic; unlike damping ring 30, they therefore cannot deform upon tilting of fan 10.

FIG. 3 furthermore shows recesses or holes 88 that are implemented in damping ring 30. Although a plurality of holes are depicted, for the sake of illustrative clarity and organization, only two holes are labeled with the reference characters 88' and 88". Holes 88 serve to define a predetermined hardness for damping ring 30 in order to determine its deformation properties and therefore its damping properties.

Figure 4:
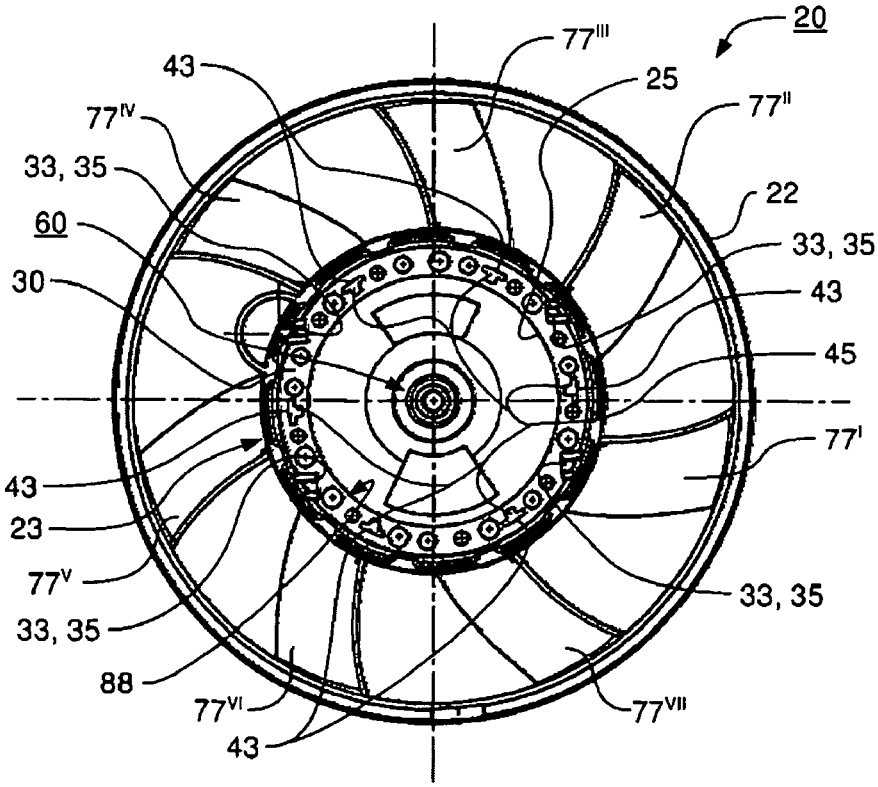
FIG. 4 is a plan view of the back side of apparatus 20 of FIG. 3.

FIG. 4 is a plan view of the back side of apparatus 20 of FIGS. 1 to 3. This illustrates the floating mounting of carrier part 25 in damping ring 30 by way of the support elements 45 arranged in the recesses 43, and shows the holes 88 provided in damping ring 30.

Figure 5:
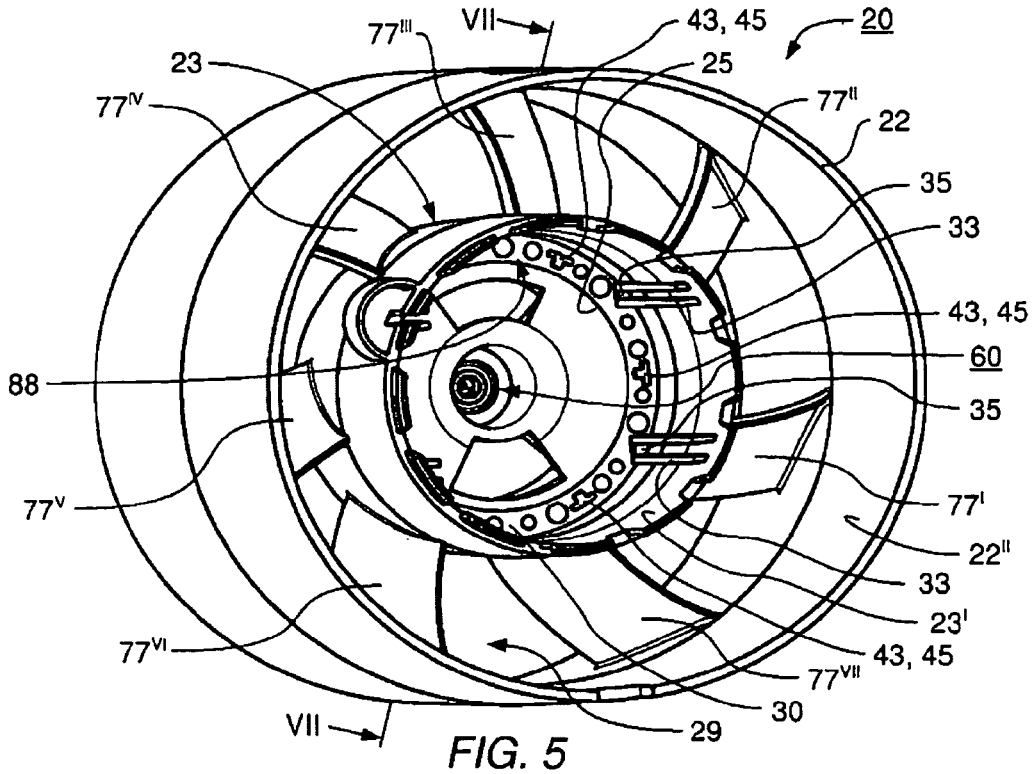
FIG. 5 is a perspective view of the back side of apparatus 20 of FIGS. 1 and 2 and FIG. 4.

FIG. 5 is a perspective view of the back side of apparatus 20 of FIGS. 1 and 2, illustrating the positioning of damping ring 30 in that region of fan unit 1 of FIGS. 1 and 2 in which air-guiding tube 22 is connected via struts 77' to 77 VII to carrier tube 23. FIG. 5 furthermore illustrates guidance slots 33 provided on inner periphery 23' of carrier tube 23, and holes 88 provided in damping ring 30.

FIG. 6 is a sectioned view of apparatus 20 of FIG. 3 looking in the direction of line VI-VI of FIG. 3. It shows portions $\mathbf{25}^{IV}$ provided on support elements 45, the positioning of sound damping ring 30 in that region of fan unit 1 of FIGS. 1 and 2 in which air-guiding tube 22 is connected via struts 77' to $\mathbf{77}^{VII}$ to carrier tube 23, and guidance grooves 33 provided on inner periphery 23' of carrier tube 23.

Figure 7:
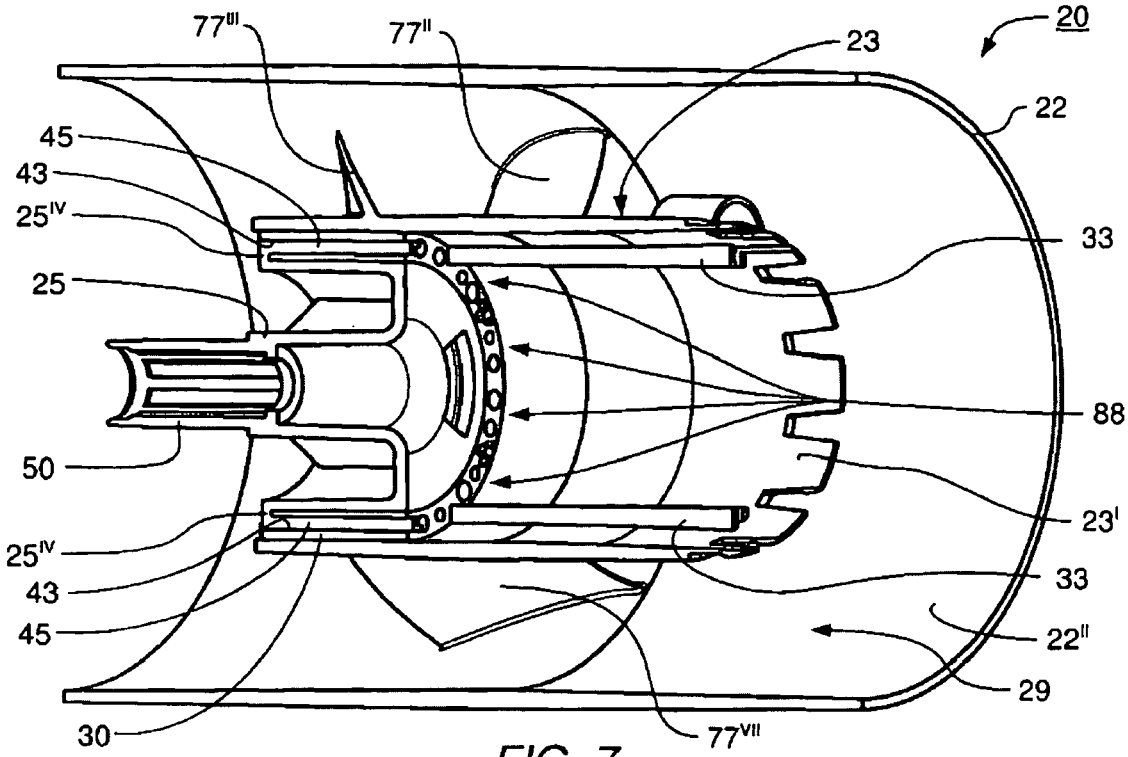
FIG. 7 is a longitudinal section, looking in the direction of line VII-VII of FIG. 5.

FIG. 7 is a sectioned view of apparatus 20 of FIG. 5 looking in the direction of line VII-VII of FIG. 5, illustrating the positioning of damping ring 30 in that region of fan unit 1 of FIGS. 1 and 2 in which air-guiding tube 22 is connected via struts 77' to $\mathbf{77}^{VII}$ to carrier tube 23. FIG. 7 furthermore shows support elements 45 of carrier part 25 that are mounted in recesses 43 of damping ring 30, and illustrates holes 88 provided in damping ring 30.

FIG. 8 is an enlarged sectioned view of carrier tube 23, of damping ring 30, and of carrier part 25 of FIG. 6. As described above with reference to FIGS. 1 and 2, these are preferably manufactured using two-component technology, and connected nonrotatably to one another. As is evident from FIG. 8, carrier tube 23 and carrier part 25 are preferably implemented from a hard plastic, and damping ring 30 is preferably implemented from a soft plastic.

FIG. 9 is a depiction of carrier part 25 illustrating bearing tube 50 provided thereon, and illustrating portions $25^{IV}$, of support elements 45 fastened on the outer edge 25" of said tube. In FIG. 9, by way of example, six at least partly resiliently implemented support elements 45' to $45^{VI}$ are connected via associated portions $25^{IV}$ to carrier part 25.

FIG. 10 is a plan view of carrier part 25 of FIG. 9 looking in the direction of arrow X of FIG. 9. FIG. 10 illustrates support elements 45' to $45^{VI}$ that are connected via portions 25' to carrier part 25.

FIG. 11 is a sectioned view of carrier part 25, which comprises, in the interior of bearing tube 50, longitudinal ribs 54 for the guidance of bearing arrangement 60 of FIGS. 1 and 2. These are beveled toward front region 25'" of bearing tube 50, and extend from that front region 25'" to an annular shoulder 56 provided in the region of outer edge 25". Said shoulder serves to immobilize rotor shaft 24' of rotor cup 24 of FIGS. 1 and 2 upon installation of fan unit 1 in carrier part 25 as described above with reference to FIGS. 1 and 2, for example by means of an annular disk.

FIG. 12 is a side view of carrier part 25 of FIGS. 1 and 2, illustrating the connection of support elements 45" and $45^{V}$ to upper edge 25" of carrier part 25 via associated portions $25^{IV}$.

Numerous variants and modifications are of course possible within the scope of the present invention.

The invention claimed is:

1. A fan unit, comprising an air guiding tube (22);

at least one carrier tube (23) having a smaller diameter than the air guiding tube (22) and forming, therewith, an annular air channel (29);

a fan (10), supported by the carrier tube (23), for transporting, in operation, air through said air channel (29);

said fan having a carrier part (25), and a damping member (30) arranged between the carrier part (25) and the carrier tube (23) to reduce, in operation, transmission of structure-borne sound from the fan (10) to said carrier part (25) and to said air guiding tube (22).

2. The fan unit according to claim 1, wherein at least one of the air-guiding tube (22), the carrier tube (23), and the carrier part (25) comprises a hard plastic.

3. The fan unit according to claim 1, wherein the damping member (30) is implemented as a damping ring made of a soft plastic.

4. The fan unit according to claim 1, wherein the air-guiding tube (22) and the carrier tube (23) are connected nonrotatably with respect to one another via at least one strut (27).

5. The fan unit according to claim 4, wherein the strut (27) is implemented from a hard plastic.

6. The fan unit according to claim 1, wherein the carrier tube (23) has, on its inner side (23'), a plurality of guidance grooves (33) that are shaped to receive guidance bars (35) provided on the outer periphery (30") of the damping member (30).

7. The fan unit according to claim 6, wherein the guidance bars (35) are arranged in the guidance grooves (33) in such a way that the damping member (30) is connected nonrotatably to the carrier tube (23).

8. The fan unit according to claim 1, wherein the damping member (30) comprises, on its inner periphery (30'), a plurality of recesses (43) that are configured for the reception of support elements (45) provided on the outer periphery (25') of the carrier part (25).

9. The fan unit according to claim 8, wherein the recesses (43) are configured to float-mount the support elements (45).

10. The fan unit according to claim 8, wherein the support elements (45) are arranged in the recesses (43) in such a way that the carrier part (25) is connected nonrotatably to the damping member (30).

11. The fan unit according to claim 1, wherein the air-guiding tube (22) is connected to the carrier tube (23) in the region of the damping member (30).

12. The fan unit according to claim 1, wherein the carrier part (25) comprises a bearing support tube (50) associated with the fan (20).

13. The fan unit according to claim 1, wherein the carrier part (25) and the bearing tube (50) are connected to one another.

14. The fan unit according to claim 1, wherein the fan (10) is an axial fan.

15. The fan unit according to claim 8, further comprising bridging portions which connect the support elements (45) to an outer edge (25") of the carrier part.

16. The fan unit according to claim 9, further comprising bridging portions which connect the support elements (45) to an outer edge (25") of the carrier part.

17. The fan unit according to claim 9, wherein the support elements (45) are arranged in the recesses (43) in such a way that the carrier part (25) is connected nonrotatably to the damping member (30).

* * * * *